United States Patent [19]

Bollag

[11] 4,214,319

[45] Jul. 29, 1980

[54] OUTERWEAR GARMENT ARTICLE

[76] Inventor: Didier Bollag, Josefstrasse 59, CH-8005 Zurich, Switzerland

[21] Appl. No.: 943,527

[22] Filed: Sep. 18, 1978

[30] Foreign Application Priority Data

Oct. 6, 1977 [CH] Switzerland ..... 12203/77

[51] Int. Cl.[2] ..... A41D 1/02

[52] U.S. Cl. ..... 2/108; 2/97; 156/93

[58] Field of Search ..... 2/97, 108, 255; 156/93, 156/222; 428/246, 249

[56] References Cited

U.S. PATENT DOCUMENTS

| | | | |
|---|---|---|---|
| 2,083,199 | 6/1937 | McBurney et al. | 156/93 X |
| 2,264,224 | 11/1941 | Swan | 156/93 X |
| 2,275,090 | 3/1942 | Reiss et al. | 2/97 |
| 2,320,950 | 6/1943 | Reiter | 2/97 |
| 3,130,417 | 4/1964 | Abalman | 2/97 |
| 3,649,399 | 3/1972 | Nakanishi | 156/93 |

*Primary Examiner*—Louis Rimrodt

*Attorney, Agent, or Firm*—Werner W. Kleeman

[57] ABSTRACT

An outerwear garment article such as a jacket of the generally unconstructed type with improved structural integrity and high wear comfort has two front parts made of an adhesive two-ply composite layer; the dorsal interconnection of the front parts consists of interconnected single-ply cloth layer segments. The composite layer is a structure obtained by adhesive melt-bonding techniques using flexible polymeric adhesives, preferably in a multiple-dot distribution.

A method of producing the novel outerwear garment article by providing two front parts in the form of two-ply cloth composites each having a protruding single-ply segment for dorsal interconnection.

12 Claims, 15 Drawing Figures

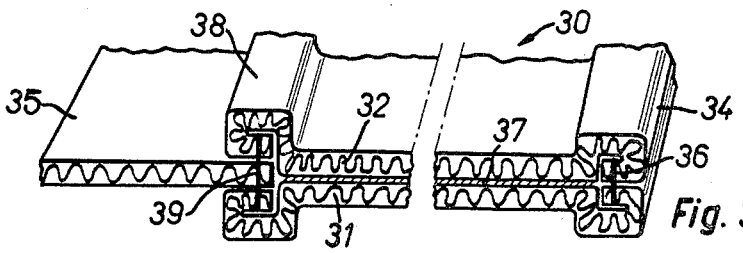
Fig. 3B
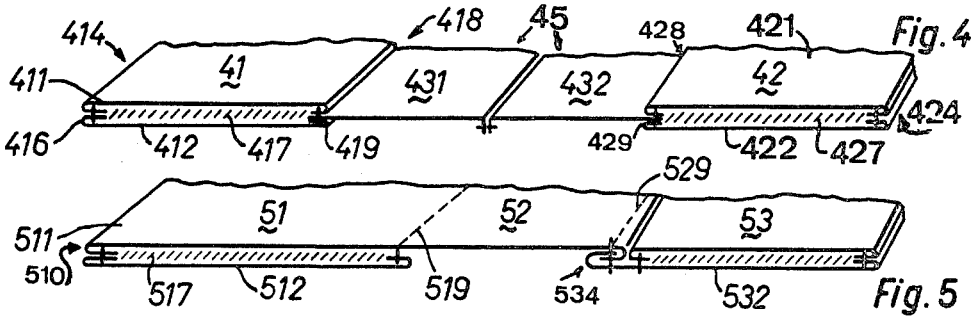
Fig. 4
Fig. 5
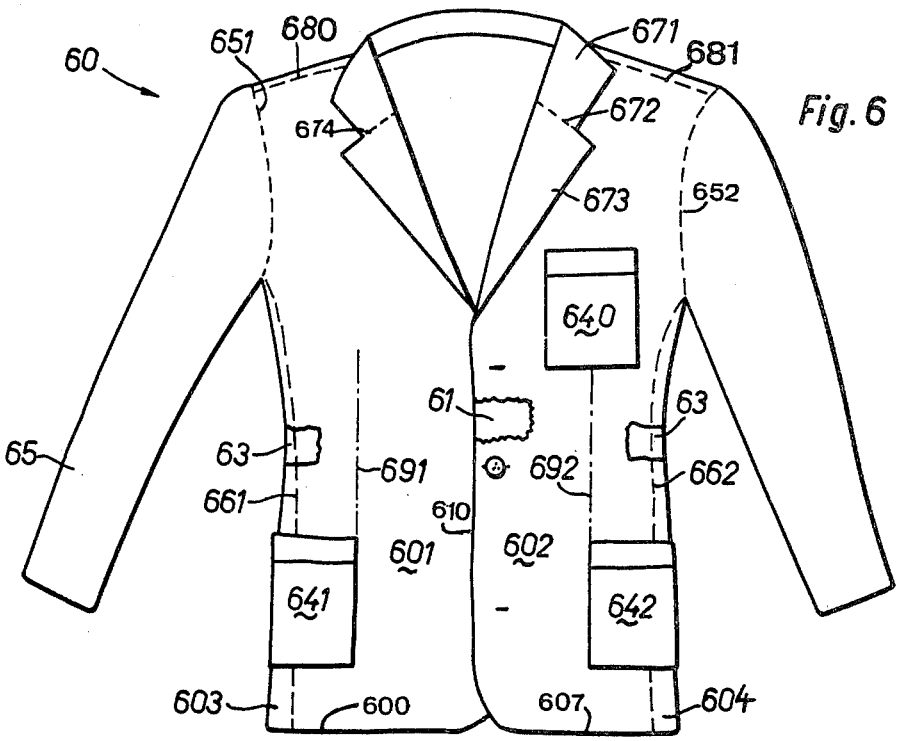
Fig. 6

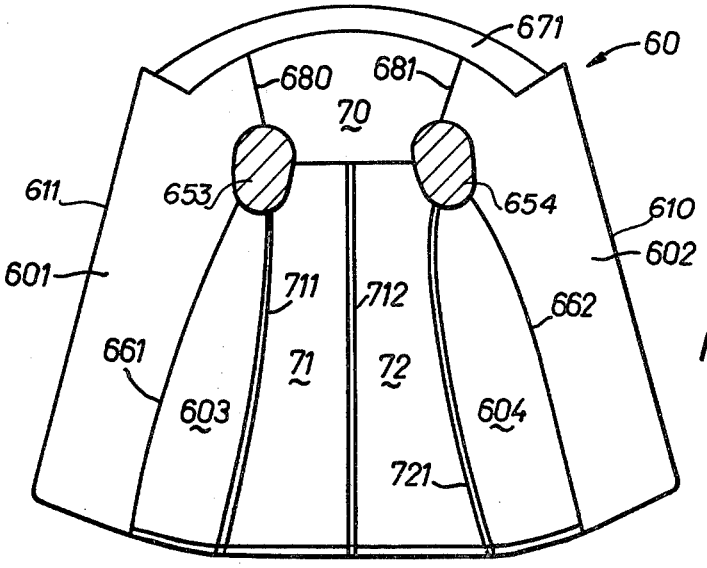
Fig. 7
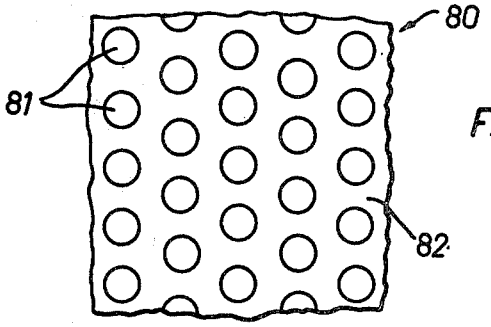
Fig. 8
Fig. 9A
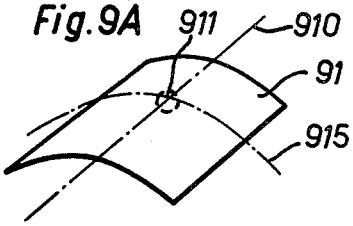
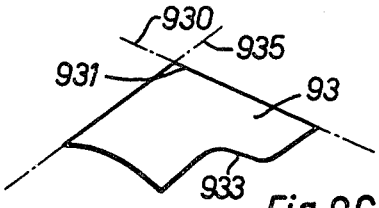
Fig. 9C
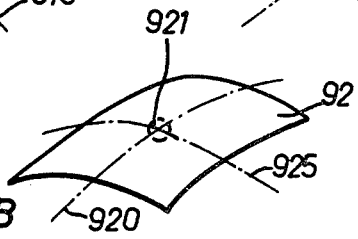
Fig. 9B

OUTERWEAR GARMENT ARTICLE

BACKGROUND OF THE INVENTION

1. Field of the Invention

The present invention generally relates to apparels and more particularly to an outerwear garmet, such as a jacket, coat or the like garment article of the type having two front parts, a dorsal interconnection of the front parts and two sleeves. The invention further relates to improved methods of manufacturing outerwear articles.

2. Description of the Art

Fashioned outerwear garment articles such as jackets or coats and other garments worn on the upper or thoracodorsal region of the human body generally comprise two front parts, a dorsal interconnection of the front parts, e.g. a sequence of side and back part segments, two sleeves and, optionally, a collar part.

As is known in the fashioning art, the structure of the front parts is important for the appearance and the wear qualities of a jacket; thus, the front parts of a conventionally fashioned jacket or coat include much tailoring and a sophisticated multi-ply structure comprising interlinings or canvas parts between the outer or top cloth layer and the inner or lining layer. As both the shape and the precise location of such reinforcements contribute substantially to the quality of outerwear garments, the amount of skill and labor required for making the front parts is a main cost factor in the manufacture of jackets and the like outerwear garments.

Interlinings provided with a thermoplastic adhesive coating are conventionally used in various parts of the front parts in order to reduce stitching operations, and various adhesives and adhesive-coated reinforcing materials are known to be suitable for this purpose. This includes the so-called latent adhesives, fusion-bonding or melt-bonding polymer adhesives, as well as specially made woven or non-woven materials, one or both surfaces of which is/are capable of adhesive or fusion bonding by virtue of suitable coatings, or by using filaments or yarns including fibrous constituents capable of adhesive or fusion type bonding. However, as visibly sewn garments are required from a marketing point of view, adhesive textile bonding techniques applied hitherto in commercial outerwear manufacture have in general been used but for securing stratiform reinforcing elements at selected portions of the inner surface of the top cloth that forms the front facing of the front parts.

For example, U.S. Pat. No. 2,275,090, issued Mar. 3, 1942, to R. H. Reiss et al discloses a top garment with two facting plies having substantially registering edge portions stitched together to form an edge seam and an intermediate ply having its longitudinal edge spaced inwardly from the edge seam. A reinforcing tape having an outer soft and flexible non-adhesive longitudinal edge portion is stitched into the seam; the inner longitudinal edge portion of the tape is provided with adhesive substantially confined to the surface of the tape portion that overlaps the intermediate ply so as to adhere only to the overlapped portion thereof. According to Reiss et al, the edge of the tape that is stitched into the seam must remain free of adhesive for maintaining the edge of the seam soft and pliable.

A similar approach is disclosed in German Published Patent Application DE-OS No. 1,460,095: an adhesive is used in the edge seam portion for forming a line of punctiform interconnections between the outer ply and a reinforcing layer, or between two top cloth layers that are joined in the front edge seam. Fusion of thermoplastics coated fabrics, such as used for flexible head coverings of motor vehicles, in the region of a stitched joint is disclosed in British patent specification No. 977,367.

On the other hand, in the production of wearing apparel of the type adapted to be laundered, e.g. shirts, it is known to produce semi-stiff collars, cuffs, plaits and the like portions that normally require starching by assembling the component pieces including an adhesive coated fabric by stitching with the uncoated surfaces arranged face to face, subsequently turning the assembly inside out to bring the two adhesive coated surfaces together and joining the components under heat and pressure for bonding or interfusing them via the adhesive. This method is disclosed, for example, in U.S. Pat. Nos. 2,083,199, issued June 8, 1937, to J. D. McBurney et al, and 2,264,224, issued Nov. 25, 1941, to T. H. Swan.

The Patent to McBurney et al states that this method is applicable to suits of linen, cotton, light weight wool or other similar fabrics having lapels and collars that may be stiffened in the same manner as shirt collars, and that lapels and collars of rain coats can be cemented to prevent puckering when sewed or when the garment becomes wet.

While a certain degree of stiffening of the lapels and collars of suits may be desirable in light-weight coats and jackets for making these parts non-wrinkling or pucker-resistant, the semistiff characteristics taught by the last mentioned patents would be quite undesirable in the front parts of a jacket or coat. For reasons of wear comfort, such front parts require a relatively soft or pliable and generally non-stiff finish that is quite distinct from a starching-type semi-stiff rigidity. In fact, a stiff of semi-stiff finish implies a substantially complete loss of drapeability and I believe that previous attempts or speculative suggestions to employ adhesive techniques for topically reinforcing outerwear articles or for producing fully reversible outerwear articles have failed because of such substantially complete loss of drapeability. A quantitative evaluation of the difference between a semi-stiff finished and a drapeably structured composite will be given below.

When experimenting with woven double fabrics, i.e. a very costly type of fabric consisting of a two-ply cloth structure in which the cloth layers are interconnected by a multiplicity of invisible stitches or threads and normally used for tailor-fashioning double-faced coats or fully reversible garments that can be worn either normally or inside out, I have found that a disadvantage of such reversible garments, notably coats, is an undesirable structuring effect due to the unintentially reinforced yet still somewhat drapeable back portion; on the other hand, the structuring effect inherent in a conventional double-face woven cloth of the type just mentioned would be quite desirable for the front parts of a jacket or the like garment. When trying to utilize this structuring effect for the jacket front parts while avoiding it in the dorsal interconnection it became apparent that an extremely laborous process and great skill on the part of the tailor would be required to make the front parts from a double-face cloth and joining them with a single-plied top cloth of the side or back part component of the dorsal connection.

In fact, the threads connecting the two cloth layers of conventional two-ply fabrics must be cut in the front edge seam areas at least; then the separated portions must be folded back and sewn; further, the connection of the single layer of the dorsal connecting portion with the two-ply front parts either requires local separation of the layers of the composite or tends to yield bulky welts. So, while my experimental jacket with composite two-plied front portions was advantageous from a structural and esthetical point of view, it was apparent to me that the structure and method just described would not be feasible in commercial top garment production.

In connection with prior art it should be mentioned here that lapelled jackets made substantially without interlining and with little or no lining of the front parts are known. They are referred to as "unconstructed", "unstructured" or "bodyless" soft jackets and constitute an important segment of the sports wear market. However, the flappy appearance of such jackets is generally believed to be a necessary or unavoidable feature and tends to preclude their use for less informal purposes.

In view of the consistent teachings of the art with regard to the stiffening effect, i.e. loss of drapeability, resulting from adhesively interconnecting two cloth layers, I did not expect that a sufficiently drapeable yet structurally effective front part of a jacket could be obtained with an adhesive composite, aside from the problems of joining such composite front parts with the dorsal interconnection in a commercially feasible manner. Surprisingly, however, I have found upon further experimentation that structurally effective yet drapeable jacket front parts can be obtained by adhesive means and that such front parts provide for body and pleasing appearance while essentially retaining the high wear comfort of unconstructed jackets.

Accordingly, it is a main object of the invention to provide for a novel outerwear garment structure wherein the two front parts substantially consist of an adhesive composite of two cloth layers while the dorsal interconnection consists essentially of a single cloth or fabric.

A further object is an improved lapelled outerwear garment that requires neither lining nor interlining of the front parts while providing a generally taylored appearance and body combined with high wear comfort.

Another object is an outerwear garment structure wherein a drapeably structured adhesive composite two-ply front part of the garment is joined with a single-ply dorsal interconnection in a simple manner.

Yet a further object of the invention is an adhesive cloth composite having a sufficient degree of drapeability and a generally soft-finish handle while providing sufficient body to an outerwear garment having its front parts made of such adhesive composite.

Still another object of the invention is a commercially advantageous method of manufacturing outerwear garments having two front parts substantially consisting of a composite two-ply cloth material and a dorsal connection consisting essentially of a single-ply cloth material.

SUMMARY OF THE INVENTION

In accordance with the present invention, I have found that the above objects can be achieved with a jacket, coat or similar outerwear garment of the type that comprises two front parts and a dorsal interconnection thereof, wherein each of said front parts comprises, or substantially consists of, two cloth layers having an internally sewn front edge seam portion and a seam portion joining each of said front parts with said dorsal interconnection; said two cloth layers of said front parts being adhesively joined or interfused in a predominant portion of each front part to form a composite layer that extends substantially from said internally sewn front edge seam portion to said connecting seam portion; said dorsal interconnection being substantially formed of a single cloth layer that may consist of two, three or more segments. In a preferred general embodiment the outerwear garment according to the invention will be lapelled and have two sleeves as well as a collar.

Preferably, the cloth layers of the composite front parts are adhesively joined or interfused by a normally flexible polymer distributed in a dotwise and substantially uniform manner between the cloth layers of the composite. It should be noted that such dotwise distribution of an adhesive in a cloth composite has been disclosed in the above mentioned U.S. patent to T. H. Swan for bonding in the production of semi-stiff shirt collars and the like as an alternative to a continuous adhesive coating implying that the dotwise distribution provides for the same type of stiffening as the continuous distribution. I have found, however, that the dotwise distribution tends to avoid stiffening and provides for a drapeably structured and substantially nontenting compsoite, i.e. one having the minimum degree of drapeability that is required in jacket front parts for reasons of wear comfort while giving sufficient body to the garment. The dorsal connection, on the other hand, preferably has a substantially tenting drapeability.

According to a preferred embodiment of the invention, the outerwear article is a lapelled jacket of the generally unconstructed and high wear comfort type yet having a structured appearance due to the surprising effects of the two-ply composite in the front parts of the jacket.

In its method aspect, the invention provides for an improvement in the method of manufacturing an outerwear garment of the type having two front parts, two sleeves, and an interconnecting dorsal part consisting of at least two segments; said method comprising the steps of producing said front parts, said sleeves and said dorsal part and connecting said parts by sewing; the improvement consisting essentially of (a) forming two separate assemblies each consisting essentially of three elongated cloth layers in a mutually superimposed relation, each of said assemblies comprising a top layer, a central layer and a bottom layer; each of said assemblies having a first edge portion where said central layer is between said top and said bottom layer and a second edge portion where said top layer is in direct contact with said bottom layer; said top and said bottom layer each constituting one ply of said one front part and said central layer constituting a segment of said interconnecting dorsal part; (b) providing a flexible melt-bonding polymer adhesive on at least one surface of each of said assemblies; (c) connecting a predominant edge portion of each of said assemblies by sewing at least said first edge portion and said second edge portion thereof; (d) reversing each of said assemblies through an unconnected edge portion thereof to obtain two inverted assemblies each consisting of said top and said bottom layer in a two-ply arrangement with said melt-bonding adhesive at a predominant interface area between said inverted layers; each of said inverted assemblies having an internally sewn terminal front edge seam combining said top and said bottom layer and an inverted connecting seam combining said top and said bottom layer with said central layer; said central layer protruding from said two-ply arrangement; (e) activating said meltbonding polymer of each of said assemblies by heat and pressure to form two adhesive composites of said two-ply arrangements with said protruding layers; and (f) sewingly connecting said protruding layers with said other segments of said dorsal part. The terms "ply" and "plied" are used interchangeably with "layer" and "layered".

BRIEF DESCRIPTION OF THE DRAWINGS

The present invention is illustrated by way of example and not limitation in the accompanying drawings in which:

FIGS. 3A and 3B are diagrammatic views of three cloth layer portions in an inverse superposition and after reversal illustrating the structure of a composite two-ply front part connected with an adjacent single-ply section or segment of the dorsal interconnection;

FIGS. 4 and 5 are diagrammatic views showing examples of interconnecting the two-ply composite front parts with interconnected single-ply segments for dorsal connection;

FIG. 6 is a semidiagrammatic frontal top view of a jacket according to the invention;

FIG. 7 is a semidiagrammatic diminuted top view of the inner side of the jacket of FIG. 6;

FIG. 8 is a semidiagrammatic top view of an enlarged cloth surface with a polymer adhesive applied in a dotwise manner for forming the two-ply composite;

FIGS. 9A, 9B and 9C are semidiagrammatic perspective views of sample shapes obtained in a test to determine drapeability characteristics of flexible stratiform materials.

DESCRIPTION OF THE PREFERRED EMBODIMENTS

It is to be understood that the sectioned perspective views of FIGS. 1 to 3 show the cloth layers and seams in exaggerated thicknesses for better illustration.

Figure 1A:
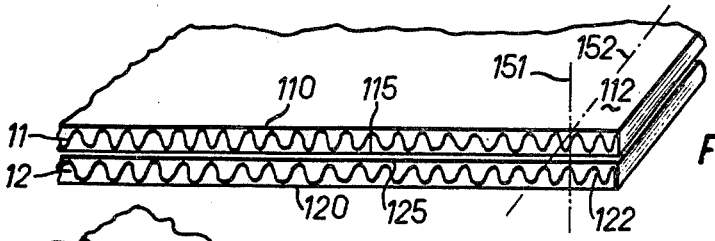
FIGS. 1A, 1B and 1C are diagrammatic views of two cloth layer portions in an inverse superposition at the beginning of their reversal and after completion of reversal showing one method of forming an internally sewn terminal front edge seam of a composite front part in a garment according to the invention.
Figure 1B:
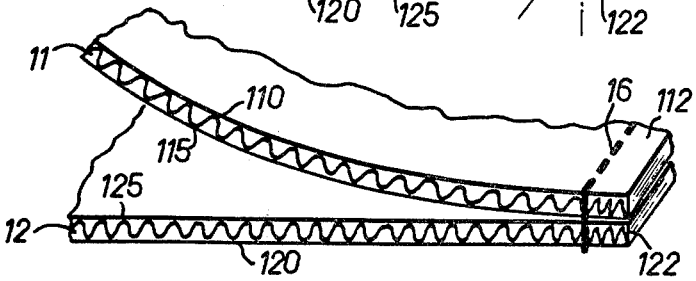
Figure 1C:
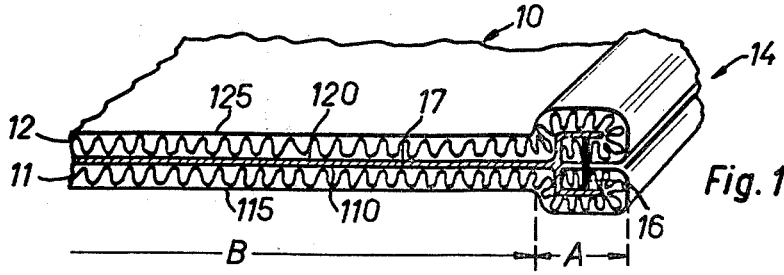

FIGS. 1A, 1B and 1C show the main steps when forming the two-ply composite layer structure near the terminal front edge seam of an outerwear garment according to the invention, e.g. in area 61 of jacket 60 shown in FIG. 6. For this purpose, two top cloth layers 11, 12 are inversely superposed, i.e. with their outer surfaces 115, 125 in mutual contact and cut if required to form registering edges 112, 122. Strict registering of these edges is not believed to be critical, however. Then, edge seam 16 is formed along dash-dotted line 152 by sewing in a conventional manner. A substantially parallel alignment of seam 16 with edges 112, 122 is preferred. However, the seam plane indicated by dash-dotted line 151 need not be perpendicular relative to layers 11, 12 and may be inclined to form an angle of less than 90° with the parallel planes of the cloth layers.

At least one of the cloth back sides or surfaces 110, 120 facing outwardly in the assembly of FIG. 1A is provided with a layer of a textile adhesive, preferably of the latent type. Upon turning of layers 11, 12 starting as shown in FIG. 1B, an internally sewn edge 14 is formed as shown in FIG. 1C; the thickness of the resulting seam or welt is exaggerated for better illustration. Now, the back sides 110, 120 of layers 11, 12 are joined by adhesive layer 17 (thickness exaggerated and preferred structure not shown) to form a two-ply cloth adhesive composite 10, e.g. by activating the latent adhesive originally applied onto at least one of the surfaces 110, 120 of cloth layers 11, 12 by exposure to heat (e.g. a temperature in the range of from about 100° C. to about 170° C.), or solvent and the like activator, generally under the impact of pressures of the type that can be achieved with conventional ironing machines, e.g. 10 grams (g) per square centimeter ($cm^2$) to 100 $g/cm^2$; the specific conditions of activating the adhesive will, of course, depend somewhat upon the type of cloth and adhesive used.

Preferably, adhesive layer 17 is not a continuous stratum but consists of a multiplicity of adhesive dots or points distributed in a substantially uniform manner, e.g. five to thirty or more dots per $cm^2$ of interface area, between the layers. The mumber of points per unit area, the dot pattern and the sizes of the adhesive dots can be varied by the amount of adhesive applied, e.g. 5 g per square meter ($m^2$) to 30 $g/m^2$, the application method, and by the surface structure of the layers in the interface area of the composite. The thickness of adhesive layer 17 in the preferred discontinuous point-array distribution normally is in the range of fractions of millimeters, e.g. from about 10 micrometers to about 250 micrometers, but the use of thicker adhesive layers 17, e.g. including a reinforcing stratum, is not precluded provided that the drapeability criteria explained below can be met.

As mentioned above, many textile adhesives are known per se and essentially all of them could be used for the adhesive composite, again provided that the drapeability criteria are kept in mind; such adhesives include those that can be activated by a solvent as well as reactive (polymerizing and/or cross-linking) adhesives and even the so-called contact adhesives would be suitable.

For reasons of dry-cleaning stability and the desired degree of drapeability, latent adhesives and notably melt-bonding adhesive or hot-sealing polymer compositions are generally preferred which meet the following criteria: (a) substantial resistance to halogenated hydrocarbons of the type normally used for dry-cleaning, i.e. substantial insolubility and limited swelling capacity of the adhesive of layer 17 in such dry-cleaning solvents, or the capacity of the adhesive to be made resistant to such solvent by suitable treatment (cross-linking); (b) flexibility and, preferably, pliability under "normal" ambient conditions (e.g. in the temperature range of from about −20° C. to about +50° C.), i.e. neither substantially embrittling nor substantially softening in that range. Pliability of the adhesive is believed to be a contributory factor to the desired drapeability properties explained in more detail below.

Adhesive materials capable of meeting these criteria, and the production of such materials, are known per se. Polymers (homopolymers or copolymers) on the basis of terephthalate/isophthalate copolyesters, copolyamides, copolyolefins are mentioned but as examples of the polymeric constituent of the adhesive. Pliable thermoplastic and elastomeric polymer adhesives are preferred. Suitable adhesives can be in the form of random fiber webs made of latently adhesive fibers or filaments or so-called "fixing foils" containing such fibers or an array of spots of a latent adhesive in discontinuous distribution on an inert carrier sheet and can be applied in this form and be preliminarily connected ("prefixed") with the cloth. The carrier sheet, e.g. paper or a relatively heat resistant polymer stratum, of such fixing foils is layed on the cloth with the adhesive spots facing the intended bonding surface of the cloth; then heat and pressure, e.g. by ironing means, are applied onto the back side of the carrier so as to transfer the adhesive, e.g. arranged in a pattern of spots on the carrier sheet, to the cloth. As is known in the adhesive art, the carrier sheet is provided with a suitable releasing agent, e.g. a silicone, to facilitate transfer to the adhesive from the carrier to the cloth in a thermal "decal" technique without substantially changing the array or pattern of the adhesive.

Instead of first applying the spots of the adhesive, e.g. in droplet form, onto the transfer or carrier sheet, the adhesive could be applied onto the cloth surface or surfaces directly, e.g. as an adhesive suspension or by spraying or scattering and subsequent thermal fusion of a solid pulverulent adhesive. The use of transfer sheets generally provides for a better control and is preferred. For example, when using preferred polyamide or copolyamide based adhesives, molten droplets can be deposited in the desired pattern on the releasingly pretreated carrier sheet, and form as well as thickness of the deposited droplets can be regulated thereon, e.g. by rolling or by controlling the viscosity of the melt. Substantially radial spots of the adhesive in the 10 to 100 micrometer thickness range with diameters of from about 0.5 to about 1.5 mm in a substantially equidistanced spot array (distances of about 0.5 to about 1.5 mm between any two adjacent spots) are suitable for many purposes of the invention.

When selecting the adhesive, the chemical and physical properties of the cloth layer constituents, e.g. when using layers containing thermoplastic synthetic fibers, as well as the cloth structure (e.g. its weaving or knitting structure) and the presence of textile finishing agents, sized and the like that may affect surface adhesion properties should be considered in a manner known per se in the art of textile adhesives. In general, the cloth layers 11, 12 should be capable of being wetted by the latent adhesive when the latter is activated.

Materials suitable for cloth layers 11, 12 of adhesive composite 10 can be selected from all types of coherent stratiform textile materials including wovens, knitted products and non-wovens made of natural, semi-synthetic or fully synthetic fibers, yarns, filaments and the like of the type normally used in the garment industry and notably the outerwear garment manufacture for producing sewn and generally fashioned articles. Materials of the synthetic leather type suitable for outerwear garments can be used as well and may have a closed surface or porous surface that may be fibrillated (suède-finish type substrates for garment production); this includes poromeric substrates of the type suitable for outerwear garments.

According to a preferred embodiment, both layers 11, 12 of the two-ply composite 10 of FIG. 1C (or the corresponding layers 21, 22 of composite 20, FIG. 2B, and the layers 31, 32 of composite 30, FIG. 3B) consist of a top cloth material, i.e. fibrous textiles, fabrics, cloth materials and the like of the type mentioned above and having typical base weights in the 100 to 900 g/m$^2$ range, preferably between 120 and 350 g/m$^2$, and strength properties suitable for garments. Woven materials made of worsted or carded yarns, e.g. those made of wool, silk, cotton, synthetics or mixed yarns (natural/natural or natural/synthetic) of the type conventionally used as top cloth materials for outerwear garments are preferred materials for both cloth layers of the adhesive composite front parts of outerwear garments according to the invention.

In general, the lateral width of composite 10 in FIG. 1C, i.e. the dimension "B" of FIG. 1C, will be substantially greater than the width "A" of edge seam 14. Width "A" is the width of seam 14, i.e. the area where a welt (exaggerated thickness shown in FIG. 1C, 2B and 3B for better illustration) is formed by the folded edge portions of cloth layers 11, 12. Some or all interfaces of these layers within seam or welt 14 can be "composited", i.e. adhesively joined, by suitably arranging the adhesive prior to turning of the layers. In a conventional jacket, the internally sewn front edge seams typically have a width in the millimeter range, e.g. 4 to 8 mm. In a jacket according to the invention, dimension "A" can be in this range as well, or above, provided that the "B" dimension is substantially greater. Beneficial structuring effects have been observed with "B" dimensions as low as 2 cm and up 50 cm. The longitudinal dimension or "length" of the composite, on the other hand, i.e. its dimension parallel with seam 14, will in general be the same as the length of seam 14 but might be somewhat smaller or greater than the latter. Further, the lateral width of the folded portions of layers 11, 12 need not be identical and one layer could somewhat project beyond the other. Substantially symmetrical structures of seam 14 are preferred.

Figure 2A:
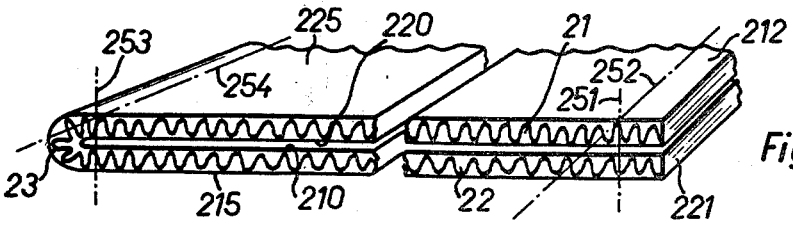
FIGS. 2A and 2B are diagrammatic views of two cloth layer portions in an inverse superposition and after reversal illustrating two methods of forming an integrally sewn terminal front edge seam of a composite front part in a garment according to the invention.
Figure 2B:
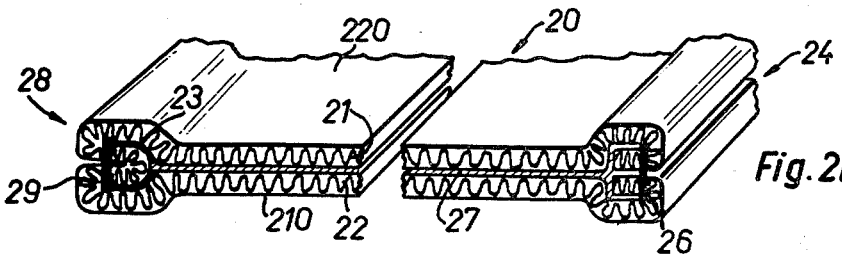

FIGS. 2A, 2B illustrate that two layers 21, 22 of the adhesive composite 20 can be parts of a single piece of cloth folded back at 23 so that the cloth back sides 215, 225 are turned outwardly (FIG. 2A). Generally, the adhesive composite 20 (FIG. 2B) will extend substantially over the entire area between the two internally sewn seams 24, 28, either of which might form the terminal edge seam of the front parts of an inventive garment while the other seam will be joined with the dorsal garment connection, preferably in the manner explained in connection with FIGS. 3A, 3B but generally as a seam that is covered on at least one side thereof. In the front part of a jacket or the like garment, seams 24, 28 will form longitudinal seams extending upwardly from the hem towards the shoulder. However, seams 24, 28 need not, and usually will not, run in parallel; while the terminal seam normally will be a substantially straight seam, the other seam may have curved or angled portions as shown below in FIG. 7. As a consequence, the lateral width ("B" in FIG. 1C) of the composite adjacent the seams of a front part between the terminal seam (24 or 28) and the connecting seam (28 or 24) may vary over the length of the composite but should in general have a minimum width "B" that is at least five times greater than "A". Non-composite interface portions between the cloth layers may be provided, e.g. to form pockets.

It is further apparent from FIGS. 2A, 2B that an internally sewn seam may be obtained not only by intersewing and reversing registeringly cut edges 212, 221 but also by intersewing layers 21, 22 near fold 23 in substantially parallel alignment with fold 23 and subsequent turning. Such internally sewn seams near fold 23 or near cut edges 212, 221 of the superposed layers may extend substantially around the periphery of the assembly as long as a non-sewn edge portion remains that permits reversing or turning.

To obtain composite 20 (FIG. 2B), the layers 21, 22 are assembled as shown in FIG. 2A and intersewn along seam lines 252, 254 in perpendicular or inclined seam planes 251, 253. As explained above, at least one of the initially "outer" surfaces 215, 225 will be provided with adhesive prior to or after sewing; after reversing the sewn assembly of FIG. 2A so that surfaces 210, 220 become the outer surfaces of the assembly, the composite structure 20 is formed by adhesive 27 with the contacting cloth surfaces 215, 225, again preferably with dotwise distribution of the adhesive, e.g. by applying heat and pressure. Fold 23 is inversed in assembly 20 and preferably bonded adhesively over most of its interface portions.

Figure 3A:
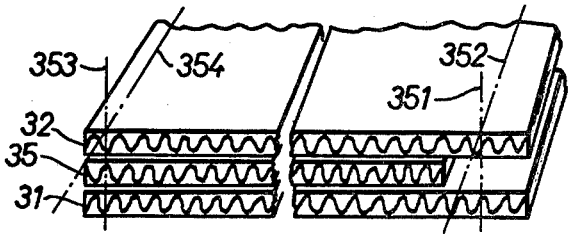

FIGS. 3A, 3B illustrate a preferred example of inversely assembling three cloth layers 31, 32, 35, intersewing all three layers along seam line 354 (seam plane 353 is perpendicular as shown or inclined) but intersewing only the two outer layers 31, 32 along seam line 352. Again as above, adhesive is provided on at least one outer surface of the assembly of FIG. 3A before or after sewing, preferably as a spot pattern. The edge of layer 35 near suture line 354 may project somewhat from the stacked assembly of FIG. 3A. Then the assembly of FIG. 3A is turned through an unsewed edge portion whereupon the adhesive is activated to form the two-ply adhesive cloth composite 30 of FIG. 3B. The important feature of this structure is that it has a single-ply interconnecting portion 36 integrated into connecting seam or welt 38 by suture 39.

Single-ply cloth 36 protrudingly extends from composite 30 and is thus capable of being used for the transition from a two-ply composite front part to the single-ply structure of the dorsal interconnection between the two front parts of a jacket or the like garment according to the invention. For example, the protruding single-ply portion 36 can be used as a side part of a jacket (603, 604 in FIG. 6), i.e. that longitudinal segment of the dorsal connection of a jacket 60 extending from hem 600, 607 upwardly to the lower part of sleeve seam 651.

The lateral dimension ("B" of FIG. 1C) of adhesive composite 30 will again be substantially defined by the distance between seams or welts 34, 48 and, again, while the terminal edge seam 34 formed by suture 36 will be generally straight in the front part of a jacket 60, the interconnecting seam 38 formed by suture 39 will be curved and/or angled as required for tailoring of jacket 60 and may be shorter than edge seam 34.

It should be noted that the width of the protruding single cloth layer 35 need not be smaller than the distance between suture or seam lines 352, 354 in the assembly of FIG. 3A. While it is essential that cloth 35 does not extend through suture line 352, a central cloth layer 35 of a greater width than that shown in FIG. 3A can be folded back at its free end portion between layers 31, 32 of the FIG. 3A assembly to prevent unintended intersewing by suture 36.

An effective yet easily obtainable connection of an adhesive composite front part with a single-ply dorsal connection is important in view of the general aim of the invention to utilize the structuring effect of two-ply cloth composites for the jacket front parts while preventing it in the jacket back parts.

This transition of two multiple-ply cloth composite front parts into a non-composite single-ply dorsal connection is diagrammatically illustrated in FIG. 4 and 5.

Two composite front parts 41, 42 each made of two-ply top cloth 411, 412; 421, 422 with adhesive interface bonding 417, 427 having one internally sewn terminal edge seam 414, 424 and a side or connecting seam 418, 428 are joined by a segmented single-ply dorsal connection 45; only two segments 431, 432 are represented for simplified illustration. However, as is conventional in jackets and the like outerwear garments, the dorsal connection between the front parts 41, 42 may include three, four or more longitudinal segments, e.g. two side parts and one back part segment, or two side parts and two back part segments, interconnected by longitudinal seams.

Various modifications of the transition from the multiple-ply front parts to the segmented single-ply dorsal connection are possible according to the invention. Two examples of such transitions are illustrated in FIG. 5. Either or both composite front parts may have the structure of front part 51, i.e. having an internally sewn terminal edge seam 510 and a side seam 519. As one of the top cloth layers 511, 512 of the two-ply composite adhesively connected at interface area 517 extends substantially beyond the composite portion, such protruding single-ply portion 52 may form a segment of the dorsal connection. When only a relatively narrow portion of one ply extends beyond the composite area shown by the connection of front part 53 and the protruding portion of cloth 532, joining with the single-ply dorsal connection may be achieved by a double fold seam 534.

As a preferred inventive outerwear garment has no lining of the front parts and little or no lining of the dorsal connection, use of double fold seams similar to that shown in FIG. 5 at 534 having one or two suture lines 529 is preferred for longitudinally joining the segments of the dorsal interconnection.

FIG. 6 is a front view of a jacket 60 according to the invention. Front parts 601, 602 are connected at their side seams 661, 662 with side parts 603, 604 of the dorsal connection (segmentation shown in FIG. 7). Pockets 640, 641, 642 may be sewn onto the front parts in a conventional manner as shown, or be formed between composite layers.

Jagged areas 61, 63 are indicated for reference purposes only: area 61 if sectioned in a plane horizontal to the jacket has the structure shown in FIG. 1C (terminal edge 14), FIG. 2A (terminal edge 24 or 28) and FIG. 3B (terminal edge 34). It is to be noted that while the terminal edge seam 610 of front part 602 is indicated, the corresponding terminal edge of the other front part 601, while covered by front part 602, has substantially the same structure, aside front the button/button hole difference.

Areas 63, on the other hand, preferably have the structure shown in the left portion of FIG. 3B but might have that shown in FIG. 5 at 519, 529 or an other type of composite/single-ply transition.

Preferably, each front part 601, 602 forms a lapel 673 as an integral portion. A collar 671 is optional and may or may not have the above explained composite structure.

Front parts 601, 602 are substantially defined by the side seams 661, 662, the hem lines 600, 607, the shoulder seams 680, 681, the sleeve seams 651, 652 and the collar seams 672, 674, i.e. by the areas between these seams and the terminal front edges. Breast darts 691,692 and other conventional fashioning means including decorative seams, pleats, zippers and the like modifications are optional and no limitation to specific tailoring modes, i.e. single-breasted jackets, is intended by FIG. 6.

According to a generally preferred embodiment of the invention, each jacket front part consists predominantly of two top cloth layers adhesively connected to form a drapeably structured composite and it is believed to be essential that such composite structure extends substantially from the terminal edge to the side seam. This does not preclude regional interruptions of the adhesive bonding layer.

As mentioned above, the lateral width of the composite and, thus, the lateral width of a front part can be in the range of from 2 to 50 cm. However, as the distance between the terminal edge seam 610 and the side seam 662 of a front part according to the invention may, and frequently will, vary over its length (distance between hem 607 and collar seam 681), the average or mean lateral width of the composite is significant and such mean width in the range of from 5 to 30 cm, preferably 10 to 25 cm, is preferred for many purposes of the invention.

It will be appreciated from the above discussion of the drawings that the concept of a generally two-ply cloth adhesive composite does not exclude that more than two plies may be interconnected locally; thus, in the terminal front edge seam as well as in the side seam more than two plies may be interconnected adhesively.

On the other hand, the dorsal interconnection of the outerwear garment of the invention has a generally single-ply structure; this does not preclude, however, that the seams joining the segments of the dorsal interconnection include several plies of cloth, e.g. as shown by seam 534 of FIG. 5 nor that a lining of the back part is provided, e.g. in the shoulder region.

FIG. 7 is a reduced-scale simplified top view of the jacket of FIG. 6 after flapping out of the front parts to show the inner side of the jacket. FIG. 7 is not intended to show correct dimensional proportions as any planar showing of the inner side of the jacket tends to include substantial distorsions.

The rear facings of front parts 601, 602 are unlined and have substantially the same apperance as the front facings. The dorsal interconnection of front parts 601, 602 include the two side portions 603, 604 and two back portions 71, 72; such a segmented structure of the dorsal interconnection of a jacket is known per se.

Lining of the dorsal interconnection, notably of the back parts 71, 72, is optional. A relatively small lining 70 extending from collar 671 to armholes 653, 654 is shown in FIG. 7 as a shoulder lining. The sleeves may be lined and shoulder pads may be included (not shown in FIG. 7).

Sutures 711, 712 and 721 are preferably in the form of folded two-suture line covered seams.

FIG. 8 is a semi-diagrammatic enlarged top view of a cloth portion 80 with an array of adhesive spots 81 applied onto cloth 80 by a superposed sheet (not shown) that carries the adhesive spots on the sheet surface next to the surface of cloth 80 and by transferring the spots from the sheet to the cloth under heat and pressure conditions suitable for prefixing. Typically, the transfer sheet carries about 20 to 30 adhesive dots 81 per $cm^2$ to provide for about 20 to 30 g of adhesive per $m^2$ of the sheet, e.g. when using preferred adhesives of the copolyamide type. The dots on the carrier sheet are substantially circular and have an average diameter of about 1 mm and an average thickness of from about 0.06 to about 0.08 mm. By the transfer from the sheet to cloth 80, the diameter of the dots will be somewhat increased, e.g. to about 1.2 mm; another diameter increase of the dots, e.g. to about 1.3 mm, may result when the adhesive two-ply cloth composite is formed from cloth 80 and the second cloth ply by heat and pressure. As a consequence, the adhesive dots that interconnect the cloth layer of the composite will have a thickness of about 50 micrometers in this example.

FIGS. 9A, 9B and 9C are semi-diagrammatic perspective views of sample configurations when testing drapeability characteristics of cloth, composite structures and adhesives. In each case, a substantially regular (square or circular) shaped sample of the material to be tested is cut. Square sample with an edge length of from 10 to 15 cm or circular samples with a diameter in that range are suitable for most materials. The sample is supported substantially at the center 911, 921, 931 of its lower surface by the top surface of a rod (not shown), e.g. the flat back end of a pencil or a cylindrical wooden rod having a plane top surface area of about 25 to 100 $mm^2$. A pin or adhesive can be used to secure the sample on the support.

If a given sample remains substantially flat, i.e. will not be deformed by its own weight into a structure similar to one of the typical configurations shown in FIG. 9A, 9B or 9C, the size of the sample can be increased or a small external load can be applied, e.g. by attaching equally distributed weights to the sample edges.

A sample of a stiff or semi-stiff flexible material will essentially show the form of FIG. 9A: it will have one substantially straight (neither curved nor bent) first mantle line 910 while a second mantle line 915 that is substantially vertical to the first straight mantle line 910 is curved. The first or straight mantle line 910 of a sample 91 of a stiff or semi-stiff material need not be parallel with one pair of edges of the sample (as shown) but could run from any edge point of the sample through the sample center to an opposite edge point. In any case, a relatively stiff material will form a sample appearing similar to that of FIG. 9A, i.e. forming a "tunnel"-type shape having one substantially straight apex or zenithal line. When loading the sample edge points defined by the intersections with the straight apex line, the tunnel will "flop", i.e. the curved or bent second mantle line of the original position (prior to loading) will become the straight or first mantle line of the "flopped" sample structure while the straight first mantle line of the original position will be the curved or bent second mantle line of the "flopped" sample structure.

When using a typical stiff or semi-stiff material such as paper, it will be observed that a significant force is required for bending the straight apex line of the sample when the latter is prevented from flopping; in the front part of a jacket this would be felt as an undesirable resistance to body movements, such as bending, and the jacket would not have high wear comfort.

Accordingly, for the purpose of this specification, a sample that tends to assume a tunnel shape and significantly resists deformation of the straight apex line when prevented from flopping is regarded to indicate a stiff or semi-stiff material that has little or no drapeability nor pliability.

On the other extreme, a drapeable or pliable material will show "tenting" rather than "tunneling" and FIG. 9C illustrates a "tenting" sample 93. The sample structure of FIG. 9C is characterized by the fact that substantially all lines 930, 935 from one sample edge or corner through the center 931 to the opposite edge or corner of sample 93 will be neither substantially straight nor curved but "kinked" or "broken" (discontinuously bent) and that the sample shows several foldings 933. For the purpose of this specification, a tenting sample indicates drapeability but substantially no structuring effect of the tested material.

A "drapeably structured" material ideally will have a sample appearance or shape of the type shown in FIG. 9B, i.e. having no straight line from one sample edge point through sample center 921 to the opposite sample edge point. A first apex line 920 may be less curved than the corresponding vertical second apex line 925 and a certain flopping tendency may be observed; further, the sample may show some folding. Most importantly, such sample, when restrained from flopping, will show no significant resistance to curvingly or bendingly deforming its apex line. Accordingly, a jacket front part made of such material will provide for high wear comfort and yet have structure or body.

The above simple tests can be used to (a) select suitable cloth materials for the composite front parts as well as for the dorsal interconnections; (b) select suitable adhesives and adhesive parameters (thickness of adhesive film, distribution and size of adhesive dots, etc.); (c) test the composite.

When testing an adhesive, either a thin film thereof per se or an adhesive layer or pattern supported by a "tenting" (i.e. pliable) carrier or substrate can be used. Adhesives that would stiffen (sample behaviour of FIG. 9A) the composite if used as a continuous adhesive film can sometimes still be used for the composite if a discontinuous or patterned distribution of the same adhesive on the composite interface yields a drapeably structured composite sample and/or if such distribution yields a tenting sample when tested on an inherently tenting substrate.

The following examples are given to further illustrate the invention.

EXAMPLE I

A jacket substantially as shown in FIGS. 6 and 7 was made from a light wool twill having a base weight of about 280 g/m$^2$. For making the composite front parts, one pair of substantially identical front part pieces was cut for the left front part; the back side of the one piece was provided with adhesive spots as illustrated in FIG. 8 (copolyamide melt bonding adhesive, 25 g/m$^2$) from a transfer sheet so that the entire back side of that piece was covered with the adhesive spot array. The two left front part pieces and the side part also cut from the wool twill were stacked as shown in FIG. 3A with the back sides of the front part pieces at the outer surfaces of the assembly and the side part as the intermediate stack layer. The rear edges of the front part pieces and the rear edge of the side part pieces were sewn in register to form connecting suture 39; then, the front pieces were intersewn from the lower end of the side part connecting seam along the hem edge and the front edge portions to the upper end of the lapel edge.

The assembly obtained was reversed through the unsewn peripheral portion. The reversed assembly was then put into a heated press for interfusion of the two front part pieces at the interface of the reversed assembly and for forming the internally sewn hem edge and the internally sewn front edge including the lapel portion.

The other (right) front part with interconnected right side part was made in an analogous manner except that the cloth pieces of the stack were those of a pair of substantially identical right front pieces and the right side part piece, all pieces being cut from the wool twill.

Then the two front parts so obtained were incorporated into a jacket in a conventional manner. The sleeves were lined while the front parts and the side parts remained unlined. The back part segments were provided with a shoulder lining.

The jacket thus obtained had a pleasingly structured appearance even though no interlining of the interfused front parts was used; as both front and rear facings of the front parts consisted of the wool twill top cloth material, the jacket had a very elegant appearance when inspected at its inner surfaces.

The wearing qualities of the jacket were exceptionally good. Specifically, the front parts of the drapeably structured two-ply composite interconnected by a freely drapeable single cloth dorsal interconnection provided the wear comfort and soft handle of an unconstructed jacket combined with a generally tailored (non-flabby) outer appearance. The sealed yet drapeable structure of the composite front part is believed to be the cause of these advantageous properties of the inventive jacket; it provides the improved structured (less informal) tailored appearance over conventional unconstructed jackets yet retains the high wear comfort. It also provides for the more pleasing appearance when inspecting the inner jacket appearance and comparing it with conventional constructed jackets where the interlining of the front part must be covered by a generally loose lining material that has a less pleasing appearance than the inner side of the composite.

EXAMPLE II

Sample behavior in the test described above in connection with FIGS. 9A, 9B, 9C was tested with samples from single-ply cloth layers and from two-ply composites obtained by adhesive bonding of a cloth layer pair. Melt bonding polyamide was used in dotwise distribution as explained in connection with FIG. 8.

The following materials having the indicated single-ply base weights (BW) in g/m$^2$ were tested both as single-ply samples and two-ply composite samples: pure wool (worsted or carded) of BW 200, 300, 270, 180, 320, 310, 335, 275, 230; 45% wool/55% polyester of BW 200 and 190; 100% silk of BW 210; 100% cashmere of BW 235; 75% polyester/25% silk of BW 215; 75% wool/25% mohair of BW 200; 100% polyester ("CRIMPLENE") of BW 255; poromeric ("ALCANTARA") material of BW 190; 55% polyester/25% angora/20% wool of BW 170; 75% polyester/25% cotton of BW 140; 88% wool/12% camel of BW 290; 97% viscose reyon/3% silk of BW 160; 65% lambswool/35% wool of BW 200.

Generally, the single-ply samples were between the configuration of FIGS. 9C and 9B while the two-ply samples were between FIGS. 9A and 9B or between FIGS. 9B and 9C; in each case, the two-ply sample was significantly more structured than the single layer.

EXAMPLE III

Jackets were made having composite two-ply front parts, single-ply dorsal connections and sleeves in the manner set forth in Example I with the modification that the top cloth used was selected from the materials set forth in Example II. Jackets with improved wear comfort (compared with similar jackets where the front parts were interlined in a conventional manner) and improved structure (compared with similar unconstructed jackets) were obtained.

In addition to the advantageous balance of wear properties and a generally well-taylored apperance of the novel outerwear structure, the invention provides substantial advantages from a production point of view.

When comparing the numbers of stations required in commercial manufacture of a conventional jacket having a similarly structured appearance due to front part interlinings with the number of stations required for commercial production of the inventive jacket, a reduction of about 50% (41 stations versus 74 stations) can be achieved by the invention.

Further, the skill and time required for the production of the jacket front parts according to the invention is substantially reduced.

In addition to the advantage that the jacket front parts require neither interlining nor lining, advantages can be obtained by combining differently structured and/or differently colored top cloth materials including poromerics for the two-ply composite. By the same token, the structuring effect of the front part composite can be varied by using differently structured layers for the two-ply composite and/or by varying type, amount and distribution pattern of the adhesive. Optimization for any specific combination can be achieved with the above described test methods.

The advantages of the inventive method as well as certain changes of the disclosed embodiments will be readily apparent to those skilled in the art. It is the applicant's intention to cover by the claims all those modifications which could be made to the embodiments of the invention chosen herein for purposes of disclosure without departing from the spirit and scope of the invention.

Protection by Letters Patent of this invention in all its aspects as the same are set forth in the appended claims is sought to the broadest extent that the prior art allows.

What I claim is:

1. In an outerwear garment article of the type comprising two front parts and a dorsal connecting part; each of said front parts having a terminal front edge seam and a side seam joining each of said front parts with said dorsal connecting part; the improvement wherein each of said front parts comprises two substantially coextensive cloth layers extending from said front edge seam to said side seam and being adhesively connected to form a drapeably structured composite stratum between said terminal front edge seam and said side seam.

2. The article of claim 1, wherein said two cloth layers of each of said front parts are adhesively connected by means of a flexible polymer adhesive provided at the interface of said cloth layers in a multiplicity of dots in a substantially uniform distribution over at at least a predominant portion of said interface.

3. The article of claim 1, wherein said side seam is an internally sewn seam including a lateral edge portion of said dorsal connecting part as a center layer between reversed edge portions of said two cloth layers, said dorsal connecting part consisting essentially of a single layer.

4. The article of claim 1, wherein said dorsal connecting part comprises at least two interconnected elongated segments extending upwardly from a hem seam portion of the article; said dorsal connecting part having two lateral segments each of which extends from said side seam of one of said front parts to a back part of said article.

5. The article of claim 4, wherein said front parts and said lateral segments are substantially unlined.

6. The article of claim 1, wherein said composite stratum is drapeably structured and substantially nontenting while said dorsal connection is substantially drapeable.

7. The article of claim 1, wherein said front parts are substantially unlined.

8. In an outerwear garment article of the type comprising two front parts and a dorsal connecting part; each of said front parts having an internally sewn terminal front edge seam and a side seam joining each of said front parts with said dorsal connecting part; the improvement wherein each of said front parts comprises two substantially coextensive cloth layers extending from said front edge seam to said side seam and being connected intermediate said terminal front edge seam and said side seam to form a composite stratum having structured drapeability connected with said dorsal connecting part which has tenting drapeability.

9. In a lapelled jacket of the unconstructed type comprising two front parts, a segmented dorsal connecting part, two sleeves and a collar part; the improvement consisting essentially of providing each of said front parts as a substantially unlined drapeably structured composite made of two top cloth layers adhesively connected over at least a predominant portion thereof by a flexible polymeric adhesive.

10. In a method of manufacturing an outerwear garment of the type having two front parts, two sleeves, and an interconnecting dorsal part consisting of at least two segments; the improvement consisting essentially of producing said front parts by (a) forming two separate assemblies each consisting essentially of three elongated cloth layers in a mutually superposed relation; each of said assemblies comprising a top layer, a central layer and a bottom layer; each of said assemblies having a first edge portion where said central layer is between said top and said bottom layer and a second edge portion where said top layer is in direct contact with said bottom layer; said top and said bottom layer each constituting one ply of said one front part and said central layer constituting a segment of said interconnecting dorsal part; (b) providing a flexible melt-bonding polymer adhesive on at least one surface of each of said assemblies; (c) connecting a predominant edge portion of each of said assemblies by sewing at least said first edge portion and said second edge portion thereof; (d) reversing each of said assemblies through an unconnected edge portion thereof to obtain two inverted assemblies, each consisting of said top and said bottom layer in a two-ply arrangement with said melt-bonding adhesive at a predominant interface area between said inverted layers; each of said inverted assemblies having an internally sewn terminal front edge seam combining said top and said bottom layer and an inverted connecting seam combining said top and said bottom layer with said central layer; said central layer protruding from said two-ply arrangement; and (e) activating said melt-bonding polymer of each of said assemblies by heat and pressure to form two adhesive composites of said two-ply arrangements.

11. The method of claim 10, wherein said flexible melt-bonding polymer adhesive is applied in step (b) onto said surface in a pattern of a multiplicity of discrete dots distributed substantially uniformly on said surface.

12. The method of claim 10, wherein said constituents of said adhesive composites of said two-ply arrangements are selected to form drapeably structured and substantially non-tenting front parts.

* * * * *